United States Patent [19]

Oeschger, Jr.

[11] 3,934,867

[45] Jan. 27, 1976

[54] COLLATING, FOLDING AND INSERTING SYSTEM

[75] Inventor: Frank A. Oeschger, Jr., East Norwalk, Conn.

[73] Assignee: Pitney-Bowes, Inc., Stamford, Conn.

[22] Filed: June 3, 1974

[21] Appl. No.: 475,435

[52] U.S. Cl. ..... 270/32

[51] Int. Cl.[2] ..... B41L 43/00

[58] Field of Search ..... 270/32, 43, 61, 62, 63–67, 270/37, 38, 45; 53/118

[56] References Cited

UNITED STATES PATENTS

| | | | |
|---|---|---|---|
| 3,133,732 | 5/1964 | Beamish et al. | 270/61 R |
| 3,552,735 | 1/1971 | Felstehausen | 270/61 X |
| 3,669,443 | 6/1972 | Noiles | 270/61 X |
| 3,752,469 | 8/1973 | Kistner | 270/61 R |
| 3,799,536 | 3/1974 | Gregoire | 270/61 R |

*Primary Examiner*—Robert W. Michell
*Assistant Examiner*—Vincent Millin
*Attorney, Agent, or Firm*—William D. Soltow, Jr.; Albert W. Scribner; Robert S. Salzman

[57] ABSTRACT

A collating, folding and inserting system having a plurality of collating stations arranged in series along a feed path. Documents are collated in seriatim along the feed path, and are then collectively stuffed into an envelope at a stuffing station located downstream of the collating stations. One or more of the collating stations can comprise a combination document folding mechanism and a document feeding mechanism. The folding and feeding combination comprises a folder feed roller for feeding one document at a time into a folding apparatus which discharges a folded document into said feeding mechanism. The feeding mechanism comprises a discharging roller which receives the folded document and discharges it to a chain driven gripper operatively movable along the feed path. The folder feed roller and the discharge feed roller are synchronously energized so that as a new document is fed into the folding apparatus at substantially the same time that a prior folded document is discharged into the feed path of the system.

9 Claims, 4 Drawing Figures

FIG. 3
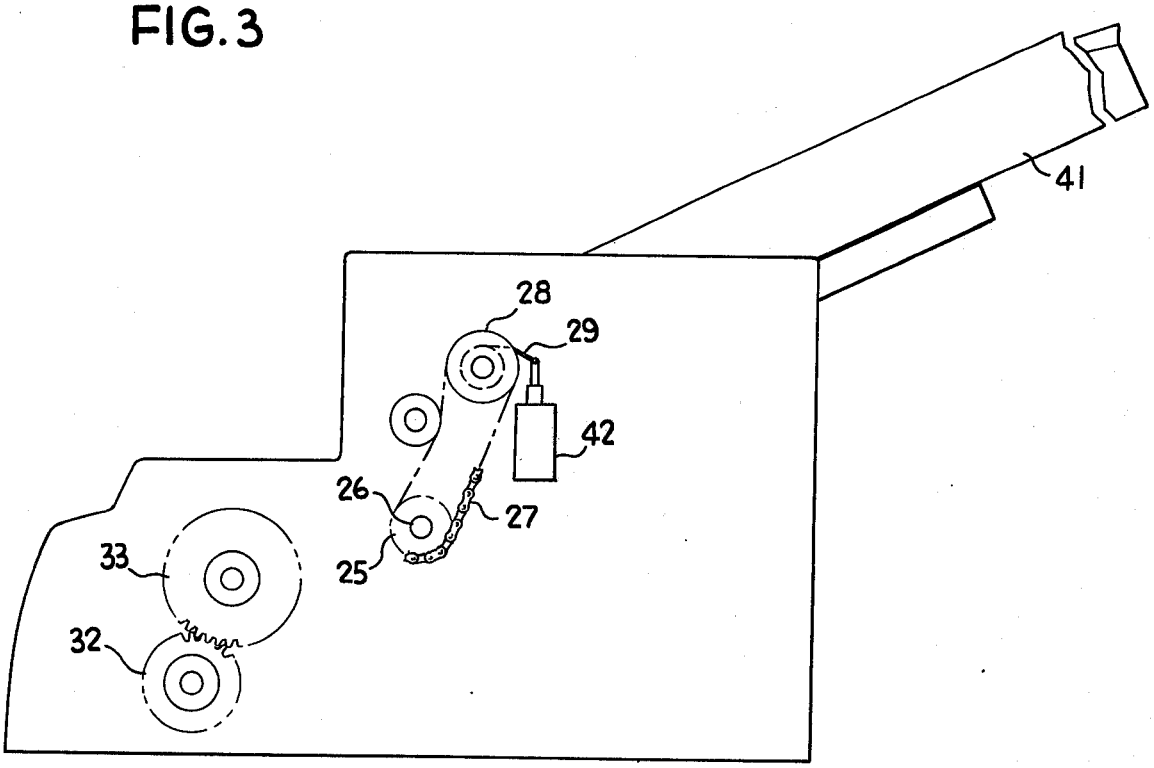
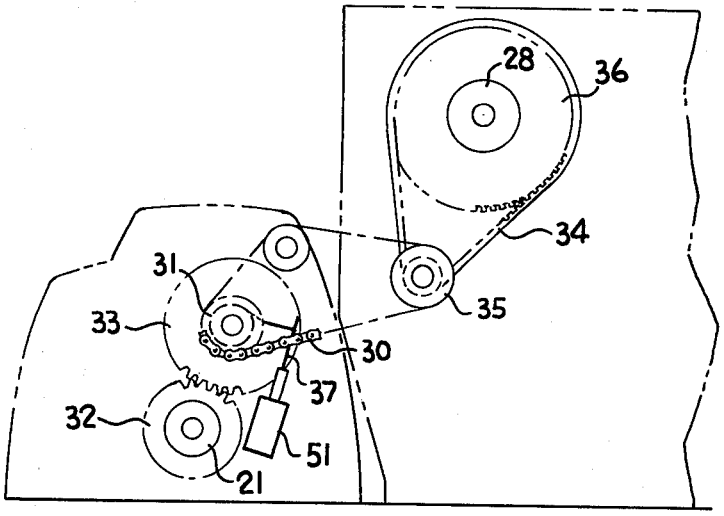
FIG. 2

COLLATING, FOLDING AND INSERTING SYSTEM

This invention pertains to a collating-stuffing machine and more particularly to a collating and stuffing system having a folding apparatus married to an inserter mechanism.

BACKGROUND OF THE INVENTION

In large scale collating and stuffing machines of the type comprising a series of collating document inserters disposed upon a feed deck, and a stuffer mechanism downstream of the collating document inserters for collectively stuffing the collated documents into an envelope, there often existed a need for inserting a larger document in the form of a folded sheet. Preliminary attempts to marry a folding apparatus to one of the collating inserters on the collating feed deck were not entirely successful. This was because, the folding apparatus was directly chain driven from the inserter apparatus through a series of overlapping chain drives. The folding apparatus was not separately clutched, so that when the inserter apparatus was disengaged from its driven mechanism via its clutch mechanism, the folding apparatus was halted in mid-operation. This had the effect of: (a) causing extreme stress upon the gears and interconnecting drive chain of the folder-inserter combination, which in turn caused the gears and drive train to experience severe wear; and (b) jamming was frequently encountered where a document was mid-way within the folding apparatus during drive train de-energization.

To alleviate the inherent drawbacks of the prior folder and inserter combination, the present invention has dichotomized the drive train, and has introduced individualized energizing and de-energizing feed controls on the folder and inserting mechanisms.

SUMMARY OF THE INVENTION

The invention relates to the marriage of a folding apparatus to an inserter mechanism as used in a collating-stuffing machine of the type comprising a plurality of collating document inserters arranged serially along a collating feed path, and a stuffing mechanism disposed downstream of the inserters. Documents are collated in seriatim along the feed path and are then collectively stuffed into an envelope.

The folder and inserter combination comprises a folding mechanism having a feed roller which feeds one document at a time into a folding apparatus. The folded document exits the folding apparatus and is received by a discharge feed roller located in the inserter. The discharge feed roller discharges the folded document to the collating gripper. The folder feed roller and the discharge feed roller are interconnected by a first sprocket wheel and chain drive mechanism.

The discharge feed roller is operated by a second sprocket wheel and chain drive mechanism which is powered by a main drive sprocket wheel. The folder feed roller is engaged by the first sprocket wheel and drive mechanism via a first solenoid actuated clutch. The discharge feed roller is clutched to the second sprocket wheel and drive means by a second solenoid actuated clutch.

The two clutches are synchronously actuated such that a folded sheet will be discharged by the discharge feed roller to the collating gripper at the same time that the folder feed roller will feed a document into the folding apparatus. The folder feed roller clutch will remain actuated for only a brief period of time so that only one document at a time will feed into the folding apparatus.

The discharge feed roller clutch will remain operative to engage the discharge feed roller with the second sprocket wheel and drive chain mechanism until such time as a folded document exits the folding apparatus and intersects an optical switch comprising a LED and phototransistor combination.

It is an object of this invention to provide an improved collating and stuffing machine;

It is another object of the invention to provide at least one inserting station on a collating-stuffing machine with a folding apparatus;

It is a further object of this invention to provide an improved folding and inserting combination for a collating and stuffing machine.

These and other objects of the invention will become more apparent and will be more fully understood with reference to the following detailed description taken in conjunction with the accompanying drawings, in which:

FIG. 2 is a side view of the folder-inserter of FIG. 1 with a previously used drive train mechanism;

FIG. 3 is a side view of the folder-inserter of this invention depicting some of the inventive modifications to the drive train.

DETAILED DESCRIPTION

Generally speaking, the invention concerns a collating and stuffing machine wherein documents are collated in seriatim along a feed path and then collectively stuffed into an envelope. The collating and stuffing machine comprises a series of collating stations each including a feeding mechanism that feeds documents to a chain driven gripper. The gripper collects the documents and delivers them to a stuffer station. At least one collating station has a document folding mechanism in combination with the document feeding mechanism.

The folding mechanism comprises a tray for supporting a stack of documents, and a folder feed roller disposed about the tray for feeding one document at a time from the tray. The document is fed to a folding apparatus and then to the feeding mechanism. The feeding mechanism comprises a discharging feed roller which receives a folded document from the folding apparatus and discharges the folded document to the chain driven gripper. A main drive means is operatively connected to the discharging feed roller for rotatively driving this roller. An interconnecting drive means is operatively connectable between the discharge roller and the folder roller. A clutch means disposed proximate of the folder feed roller is used to engage and disengage the interconnecting drive means to and from the folder feed roller.

The collating and stuffing machine of this invention is of the type manufactured by Pitney-Bowes, Inc. of Stamford, Connecticut, having a model designation No. 3140. The folder apparatus shown and described herein is also a Pitney Bowes product, and has a model designation No. 1830. Unless otherwise directly stated to the contrary herein, both pieces of hardware are constructed and operate as is commercially and commonly known.

Figure 1:
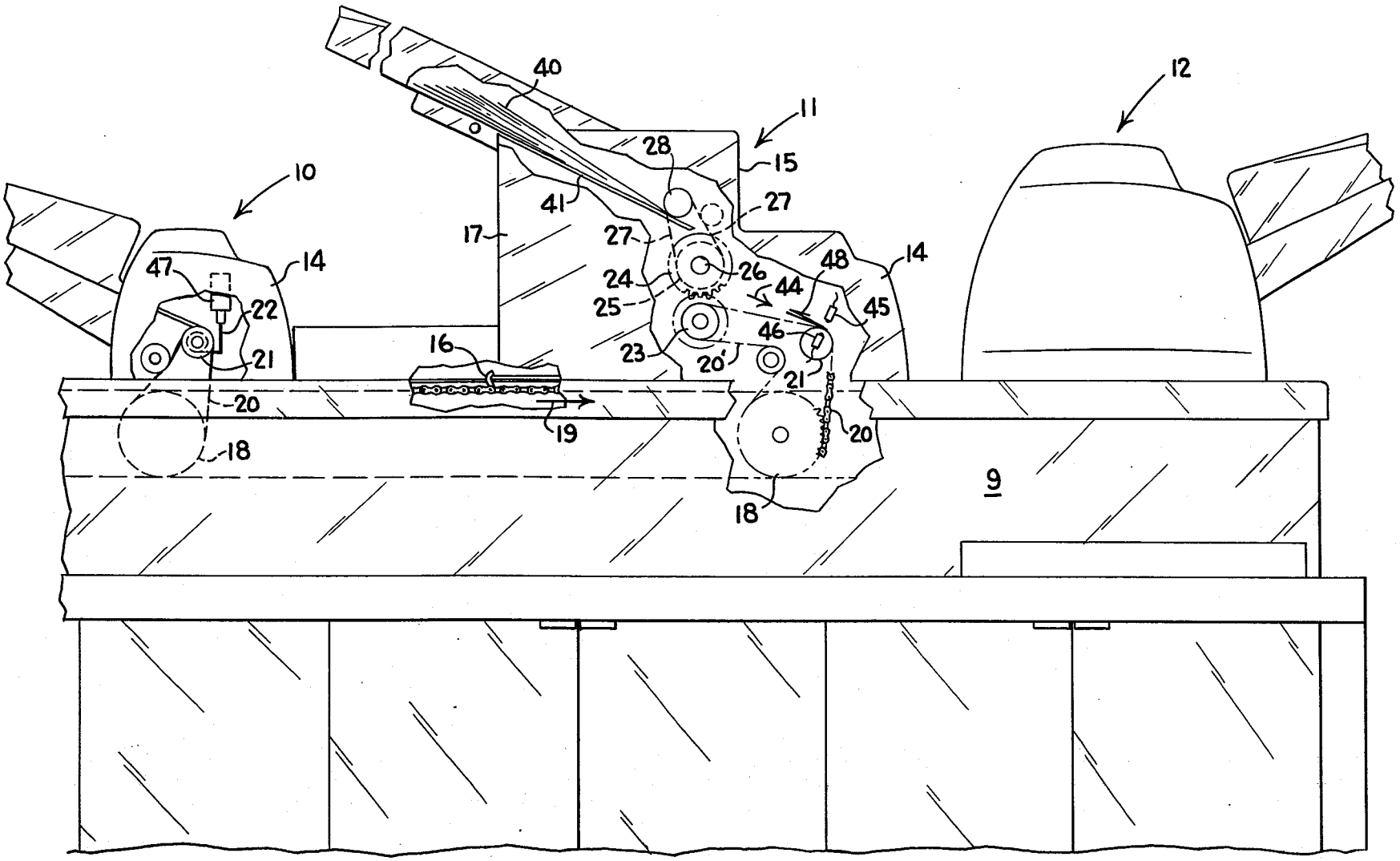
FIG. 1 is a side view of an end portion of a collating and stuffing apparatus comprising the folder-inserter combination of this invention shown in partial cutaway.

Now referring to FIG. 1 a collating-stuffing machine 9 is shown having collating stations 10 (typical) and 11 and a stuffing station 12. The collating stations may comprise either a single inserter 14 such as shown at station 10, or a folder-inserter combination 15 such as depicted at station 11. The folder apparatus 17 of the folder-inserter combination 15 folds large size documents and discharges the folded document to the inserter 14. The inserter 14 discharges the folded document to a chain driven gripper 16, that cyclically moves between each station along a feed path shown generally by arrow 19. The gripper 16 collects a document at each station as it moves past, and collectively delivers these documents to the stuffing station 12. The stuffing station inserts the collected documents into an envelope.

Each collating station is powered by a rotating main drive sprocket wheel 18. A drive chain 20 (as shown at station 10) wraps about the sprocket wheel 18 and powers the discharging feed roller 21 of each inserter 14. The sprocketed inserter discharge feed roller 21 is engaged by the drive chain 20, when a solenoid-actuated clutch 22 is energized.

When a folder apparatus 17 of this invention (station 11) is married to an inserter 14, the chain 20 is extended to the left, to become chain element 20′ which powers the folder sprocket wheel 23 as shown. Wheel 23 drives gear 24, which in turn is rotatively fixed to sprocket wheel 25 (FIGS. 1 and 3) via shaft 26. A second drive chain 27 interconnects the sprocket wheel 25 with a sprocket driven feed roller 28. A solenoid-actuated clutch 29 (FIG. 3) engages the sprocket driven folder feed roller 28 with the drive chain 27.

The successful marriage of the folder and inserter as shown in FIGS. 1 and 3, requires that the folder feed and discharge rollers are independently controlled despite the fact that both systems are driven by an interconnecting drive. As is shown, this has been accomplished by independently clutching folder feed and discharge rollers 21 and 28. The drive train has been dichotomized into two chain drives 20 and 20′ and 27 to accommodate the split in clutching.

The prior attempt to join the folder and inserter was not practical. The folder was controlled by the then doubly clutched inserter. The train drive of FIG. 2 represents the prior drive system. As is shown, the chain 30 is driven by sprocket wheel 31 via intermeshing gears 32 and 33. Gear 32 is rotatively fixed to the inserter discharge feed roller 21, which is driven by the standard chain configuration 20.

Another drive chain 34 is driven by chain 30 through a double geared intermediary sprocket wheel 35. The chain 34 drives gear 36 which is rotatively secured to the folder feed roller 28 as shown.

The drawbacks of the prior drive and control system of FIG. 2, was that the inserter demand feed control would also act as a control for the folding apparatus. Thus, documents would often be stopped in the process of being folded, which tended to increase the probabilities of jamming the machinery. In addition, the whole drive system was made to stop all at once, which caused severe strain on the gear and chain drive system. This resulted in substantial wear to the gears. This wear was commercially unacceptable.

OPERATION OF THE SYSTEM

Operation of the folder-inserter will be explained with reference to FIGS. 1, 3 and 4.

As aforementioned, station 11 shows the folder and inserter combination of this invention. A stack 40 of documents are supported on a tray 41 carried by the folder. Feed roller 28 is clutched into engagement with the drive train 27, when a demand feed signal is provided to the clutch 29 by the collator-stuffing machinery. A sheet or document from the stack 40 is positioned under the feed roller 28, and is fed into the folding apparatus (not shown) when the feed roller is engaged with the drive 27. The clutch 29 has a solenoid 42 (FIGS. 3 and 4) which is only briefly de-energized by the demand signal by means of relay 43 (FIG. 4), so that only one sheet is fed to the folding apparatus. By the time that solenoid 42 is energized again, a new sheet from stack 40 has been positioned under roller 28.

When the document has been folded by the folding apparatus (not shown), it exits the folder as generally shown by arrow 44. The document then intersects an optical switch comprising an LED 45 and a phototransistor 46 (FIGS. 1 and 4). When the light generated by the LED 45 is blocked by the folded sheet, such that phototransistor 46 sees no light, the solenoid 47 of clutch 22 (FIGS. 1 and 4) is energized. This causes feed roller 21 to disengage from drive chain 20 and 20′. The folded document 48 is then stuck in position upon roller 21 as shown in FIG. 1.

The discharge feed roller 21 will not discharge the folded document 48 to the gripper 16, until such time as the collator-stuffing machinery supplies a new demand feed signal. When a new demand feed signal is received, the folded document 48 is discharged at the same time that a new document is fed to the folding apparatus. This can be seen to be true, since both clutch solenoids 42 and 47 are operative upon receipt of the demand feed signal. It is also to be noted that while the discharge roller 21 is generally continually running, the folder feed roller 28 is only active for only a brief time that the relay 43 (FIG. 4) is closed.

Figure 4:
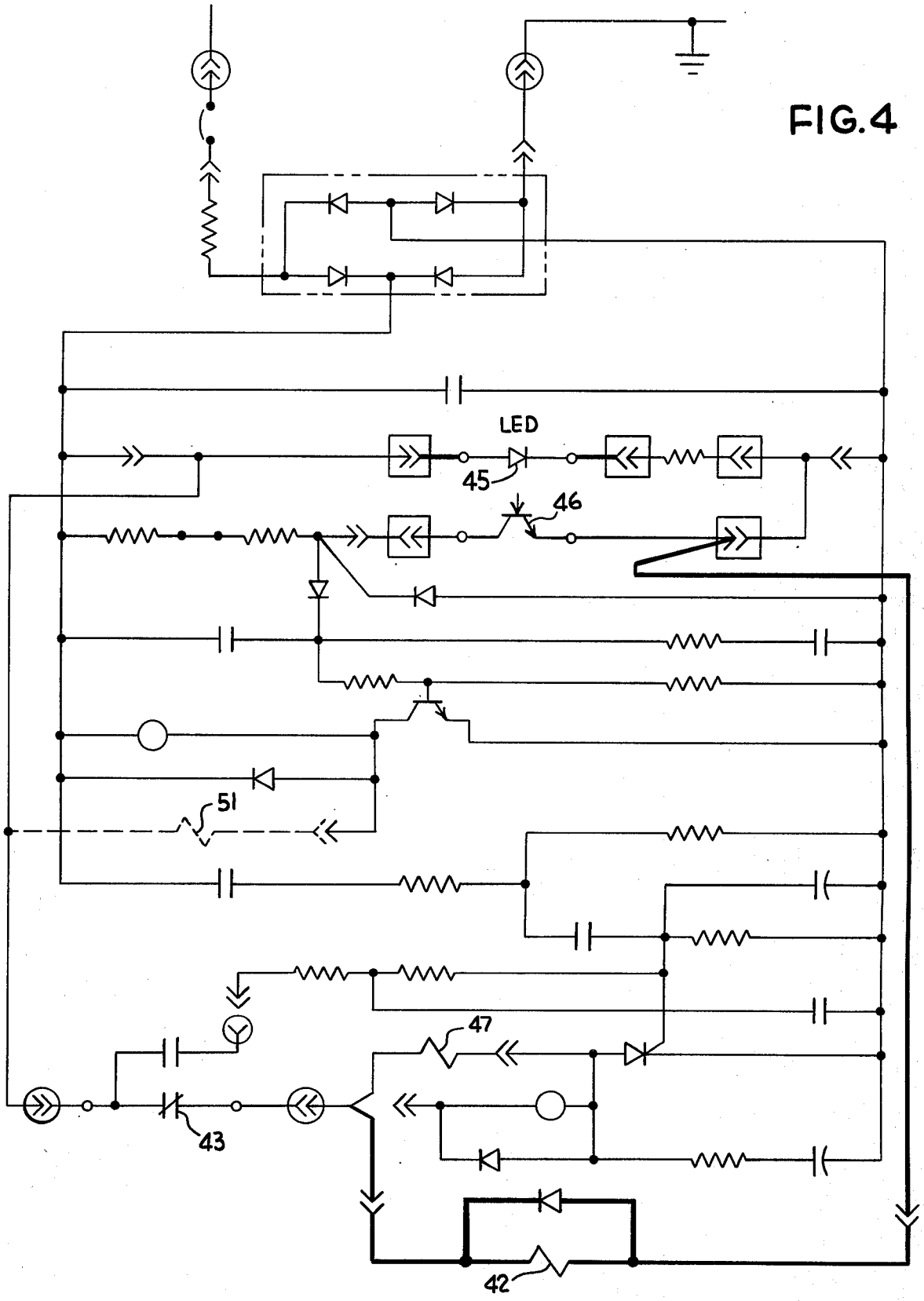
FIG. 4 is a schematic diagram depicting the circuit modifications made to the inserter circuitry in accordance with the invention.

FIG. 4 shows the general electrical diagram for inserter operation. When the folder is added to the inserter, the clutch 37 (FIG. 2) is removed along with its solenoid 51, shown in phantom in FIG. 4.

The clutch 29 is added to the system (FIG. 3) along with its solenoid 42 as shown in heavy lines in the wiring diagram of FIG. 4.

Naturally, there will occur to those skilled in this art, modifications of an obvious nature. Therefore, the scope, depth, breadth, and spirit of the invention is considered to encompass changes of a practical fashion which can be made.

The limits of the invention, and the scope thereof, should be interpreted by reference to the appended claims.

What is claimed is:

1. A collating and stuffing machine wherein documents are collated in seriatim along a feed path and then collectively stuffed into an envelope, said collating and stuffing machine comprising a plurality of document collating stations arranged in series along said feed path, each collating station having a document feeding mechanism that feeds documents to a chain driven gripper operatively movable along said feed path towards a stuffing station, at least one of said collating stations having a document folding mechanism in combination with said document feeding mechanism, said folding mechanism comprising a tray for supporting a stack of documents, a folder feed roller disposed about the tray for feeding one document at a time from said tray into a folding apparatus and subsequently to said document feeding mechanism, said document feeding mechanism being operatively joined to said folding apparatus to receive folded documents from said folding apparatus, said document feeding mechanism having a discharging feed roller for receiving a folded document and discharging said folded document to said chain driven gripper, main drive means operatively connected to said discharging feed roller for rotatively driving said discharging feed roller, interconnecting drive means operatively connectable between said discharge feed roller and said folder feed roller, and clutch means disposed proximate of said folder feed roller for engaging and disengaging said interconnecting drive means to and from said folder feed roller.

2. The collating and stuffing machine of claim 1, further comprising a second clutch means disposed proximate of said discharging feed roller, said second clutch means engaging and disengaging said discharging feed roller to and from said main drive means.

3. The collating and stuffing machine of claim 2, wherein said first clutch means is synchronously operative with said second clutch means.

4. The collating and stuffing machine of claim 3, further comprising a switching means disposed proximate of said discharging feed roller, said switching means being operative to actuate the second clutch means to disengage the discharging roller when a folded document operatively actuates said switching means.

5. The collating and stuffing machine of claim 4, wherein said switching means is an optical-type switch, and is actuated when said folded document intersects a light path of said optical switch.

6. A document feed and folding device carried by a collator and stuffing machine, comprising:

a main drive means operatively supported by said collator and stuffing machine;

first and second sprocket wheel and chain drive mechanisms operatively connected to each other, the second sprocket wheel and chain drive mechanism being operatively connected to said main drive means;

a tray carried by a folding device for supporting a quantity of documents to be fed into a folding apparatus;

a feed roller carried by said tray for feeding said tray supported documents into said folding apparatus; and a clutch mechanism interdisposed between and operatively connecting and disconnecting said feed roller to and from said first sprocket wheel and chain drive mechanism.

7. A document folding and feeding mechanism for a collator and envelope stuffing system, comprising:

a tray carried by a folding and feeding mechanism for supporting a quantity of documents to be folded;

a first feed roller supported by said tray for feeding said documents into said folding and feeding mechanism;

a main drive means operatively supported by said collator and envelope stuffing system;

a first sprocket wheel and chain drive mechanism operatively connected to said main drive means;

a second sprocket wheel and chain drive mechanism operatively connected to said first sprocket wheel and chain drive mechanism;

a first clutch means interposed between said first feed roller and said second sprocket wheel and chain drive mechanism for operatively connecting and disconnecting said first feed roller to and from said second sprocket wheel and chain drive mechanism;

a first solenoid associated with said first clutch means for actuating said first clutch means in response to a demand feed signal provided by said collector and envelope stuffing system;

a second clutch means interdisposed between said second feed roller and said first sprocket wheel and chain drive mechanism for operatively connecting and disconnecting said second feed roller to and from said first sprocket wheel and chain drive mechanism; and a second solenoid associated with said second clutch means for de-actuating said second clutch means in response to a demand signal provided by said collator and envelope stuffing system.

8. A method of folding and discharging a document into a collating feed path comprising the steps of:

a. positioning a first document to be folded under a folder feed roller carried by a document supportive feed tray;

b. engaging said folder feed roller with a folder drive mechanism to rotatively drive said folder feed roller so that said first document will be fed by said folder feed roller into a folding mechanism;

c. folding said first document;

d. disengaging said folder feed roller with said folder drive mechanism after said first document is fed by said feed roller into said folding mechanism, and allowing for a subsequent document to be positioned under said folder feed roller;

e. discharging said folded first document from said folding mechanism to a discharging feed roller;

f. engaging said discharging feed roller with a discharging drive mechanism to rotatively drive said discharging feed roller so that said folded first document is discharged into a collating feed path; and g. simultaneously with the engaging of the discharging feed roller of step (f), engaging the folder feed roller with said folder drive mechanism so that the subsequent document will be fed by said folder feed roller into said folding mechanism at substantially the same time the folded first document is being discharged into said collating feed path.

9. The method of claim 8, wherein said discharging feed roller is disengaged from the discharging drive mechanism when said folded first document is discharged from said folding mechanism to the discharging feed roller, and then engaged with the discharging drive mechanism when the folder feed roller is simultaneously engaged with the folder drive mechanism to feed the subsequent document to said folding mechanism.

* * * * *

UNITED STATES PATENT OFFICE
CERTIFICATE OF CORRECTION

Patent No. 3,934,867 Dated January 27, 1976

Inventor(s) Frank A. Oeschger, Jr.

It is certified that error appears in the above-identified patent and that said Letters Patent are hereby corrected as shown below:

Claim 7, Column 6, line 18, change "by said collector" to --by said collator--.

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*